US005708327A

United States Patent [19]

O'Boyle

[11] Patent Number: 5,708,327

[45] Date of Patent: Jan. 13, 1998

[54] FLAT PANEL DISPLAY WITH MAGNETIC FIELD EMITTER

[75] Inventor: John O. O'Boyle, Redwood City, Calif.

[73] Assignee: National Semiconductor Corporation, Santa Clara, Calif.

[21] Appl. No.: 665,566

[22] Filed: Jun. 18, 1996

[51] Int. Cl.[6] ..... H01J 19/24

[52] U.S. Cl. ..... 313/495; 313/497; 313/309

[58] Field of Search ..... 313/495, 496, 313/497, 336, 309, 351; 250/306

[56] References Cited

U.S. PATENT DOCUMENTS

| | | | |
|---|---|---|---|
| 4,141,405 | 2/1979 | Spindt | 164/46 |
| 4,663,559 | 5/1987 | Christensen | 313/336 |
| 4,857,799 | 8/1989 | Spindt et al. | 313/495 |
| 4,874,981 | 10/1989 | Spindt | 313/309 |
| 4,926,056 | 5/1990 | Spindt | 250/423 |
| 4,985,627 | 1/1991 | Gutierrez et al. | 250/306 |
| 5,015,912 | 5/1991 | Spindt et al. | 313/495 |
| 5,064,396 | 11/1991 | Spindt | 445/50 |
| 5,235,244 | 8/1993 | Spindt | 313/495 |

OTHER PUBLICATIONS

Lieberman, D., "*FEDS Are Coming To Town,*" OEM Mag., (Apr. 1995), pp. 45–51.

Edmondson, G. et al., "The Grand Alliance in Flat Panels," Science & Technology, *Business Week* Mag., Aug. 28, 1995, pp. 73–74.

*Primary Examiner*—Nimeshkumar Patel
*Assistant Examiner*—Michael Day
*Attorney, Agent, or Firm*—Limbach & Limbach L.L.P.

[57] ABSTRACT

A flat panel display device (50) includes magnetic field emitter elements (52). The emitter elements (52) include a dopant ferromagnetic material (56) used to produce a permanent magnet in the emitter elements (52). The permanent magnet in the emitter elements (52) generates a magnetic field (B) used to focus the electrons emitted from the tips of the emitter elements (52). The flat panel display device (50) further includes a voltage source (70) for producing an electric field (E) between a cathode electrode (54) having a gate electrode (58), and an anode electrode (60) having phosphor regions (62) disposed between black matrix regions (61). The magnetic field (B) provides a restoring magnetic force to collimate the electrons toward the phosphor regions (62) to produce a high brightness display.

13 Claims, 2 Drawing Sheets

FLAT PANEL DISPLAY WITH MAGNETIC FIELD EMITTER

TECHNICAL FIELD

The present invention relates to field emission elements used as electron sources for flat-panel display devices, and more specifically, to a magnetically focused field emitter element for use in a high brightness, flat-panel field emission display.

BACKGROUND OF THE INVENTION

Field emission is a quantum-mechanical effect in which electrons are emitted from a metal or semiconductor when the material is placed under the influence of an electric field. The electric field distorts the shape of the potential barrier which otherwise prevents the electrons from escaping. In the case of field emission, electrons tunnel through the potential barrier, instead of escaping over it, as in the case of thermionic or photoemission processes.

Field emission of electrons is typically produced by placing a sharply pointed emitting element into an evacuated region in which exists an electric field. The field emitter serves as the electron source or cathode with the electric field being established between the emitter (which is mounted on an electrode surface) and an anode surface. The electric field alters the shape of the potential barrier at the tip of the emitter, permitting some electrons to tunnel through the altered barrier and escape from the tip of the emitter.

The emitted electrons travel along the electric field force lines which diverge radially from the tip of the element. The emitted electrons follow the electric field force lines until they impact the anode, where the anode may be incorporated with a fluorescent screen or other suitable detector. However, because the electric field lines diverge from the emitter tip, the electrons which impact the anode do not form a highly collimated beam. This affects the brightness of the display. Since a field emitting element may be used as a source of electrons similar to an electron gun, arrays of such emitters have been investigated for use in display devices in computers and other equipment. In particular, an array of field emitters has been suggested for use in flat-panel displays.

FIG. 1 shows the primary components of a section of a typical field emission display device 10. A field emission display device typically uses an array of thousands to millions of emitters 12 as the electron emission source, with hundreds to thousands of emitter elements being used for each pixel of an image. The emitter arrays for each pixel may be separated into three elements corresponding to each of three sub-pixels, one of which is used to produce each of the three primary colors (red, green, blue) for that pixel by exciting the appropriate phosphor type for each color. Note that in some cases four sub-pixels may be used: red, green, and 2 blue sub-pixels. The array of emitters 12 shown in FIG. 1 is meant to represent the emitters used to excite the phosphor 14 for one of the three primary colors. Similar groups of emitters and the associated phosphors would be used to produce the other primary colors.

Emitters 12 typically are of a needle or conical shape and are fabricated on a cathode substrate 16 using fabrication methods similar to those used to make integrated circuits. Cathode substrate 16 forms one electrode surface for device 10 and electrically connects emitters 12 to each other. Cathode electrode 16 may be mounted on a support substrate 18 (typically made of glass) which provides structural support for the device. An insulating layer 20 is deposited on top of cathode electrode 16 and around the base of the emitters. Layer 20 electrically isolates cathode electrode 16 from the other layers of the device. A gate electrode layer 22 formed above insulating layer 20 is used to control the extraction of the electrons from the tips of emitters 12. The gate electrode is modulated by an external voltage to increase the electric field concentration at the tip of the emitter until electrons are released from the tip. The electrons are caused to be emitted from the tips of emitter elements 12 by the applied gate electrode voltage. The emitted electrons travel through openings in gate layer 22, accelerate from cathode 16 to anode 24 under the influence of an electric field, and propagate to one of a group of red, green, or blue phosphors 14. Phosphors 14 are covered by a conducting surface 24 (typically a layer of aluminum) which holds phosphor 14 onto screen 26 (typically made of glass), serves as a reflector for photons striking it, and as noted, serves as the anode electrode. When the emitted electrons impact anode 24, they possess sufficient energy to pass through the aluminum layer and strike the phosphor regions 14, producing photons 30 which are emitted and viewed as light through screen 26.

Emitters 12 can be fabricated from silicon, molybdenum, tungsten fibers, carbon, or another suitable low work function conductor. Photolithography and other semiconductor processing methods can be used to form regularly spaced arrays of silicon needles or cones.

In order to achieve high brightness for the images formed on the screen, it is desirable that the electrons emitted from the emitter tip(s) be prevented from diverging too much as they travel to the screen. One means of accomplishing this "electron focusing" function is to place the cathode array(s) in close proximity to the screen. This prevents the electrons from diverging into the region of an adjacent sub-pixel as they propagate to the screen. However, a disadvantage of this "proximity" focusing method is that it restricts the separation allowed between the cathode array and the screen. In addition, depending upon the voltages used to extract the electrons and control their motion to the anode, the electrons may still diverge too much at the anode to achieve the desired brightness. For high voltage operation, a suitable spacing between the anode and cathode is required to prevent "arc over". This situation acts to oppose the proximity of the cathode and anode required by this focusing method. These disadvantages limit the usefulness of displays which incorporate such a focusing method.

A general method of focusing the electrons emitted from an array of field emitters is to utilize a focusing electrode placed in between the gate layer and the screen, and insulated from the gate layer. The focus electrode is connected to a power supply and is used to produce an electric field region through which the electrons pass as they propagate to the screen. The electric field acts to deflect the expanding electron beam emitted from the emitter tip(s) and force the electron motion to be along the substantially parallel electric field lines produced between the cathode and anode. This serves to collimate the electron beam before it impacts the screen. This focusing method is referred to as "electrostatic focusing". The primary disadvantage of this focusing method is that it requires a more complex fabrication process since an additional electrode must be used, and the use of a secondary power supply. This focusing method also results in a reduction in screen brightness since some of the emitted electrons don't reach the screen. The result is a more complex and expensive manufacturing process.

Another method of focusing the electrons emitted by an array of field emitters is to utilize a switched high anode voltage. This produces a strong electric field at each sub-pixel which acts to accelerate the electrons in a straighter path to each individual sub-pixel. This "self-focusing" method can be used to overcome some of the limitations of the proximity method by permitting a greater separation between the cathode and anode, however, it requires an application in which switchable anode voltages are available. It also increases fabrication costs since high voltage drivers are required to switch the anode voltage for each sub-pixel.

Another proposed focusing method involves controlling the potential field pattern created by the gate layer structures used to extract the electrons from the emitter tip(s). This is accomplished by varying the potential differences between the annular gate electrode surrounding field emitters at different spatial locations. The resulting electric field causes electrons to be emitted from the emitter tip(s) and serves to focus the emitted electrons into a set of generally parallel beams. This focusing method requires discrete and varying control of the emitter regions over the entire surface of the array. This adds a level of complexity to the device, increasing its cost and manufacturing difficulty.

Another proposed focusing method is one in which an expanding electron beam is collimated without the use of an external electrode. A dielectric element is positioned around the path of the electron beam. When the electrons are emitted from the emitter tips, they bombard the dielectric, placing a negative electrostatic charge on the dielectric. This produces an electric field which deflects the electron beam from the surfaces of the dielectric and acts to contract the expanding electron beam. However, this focusing method is difficult to fabricate and adds process steps to the manufacturing of the display device. The method increases the cost of the display while decreasing the beam energy and hence pixel brightness at the screen.

Although all of the described focusing methods can be used to collimate the electrons emitted by an array of field emitters, they each have one or more disadvantages. These disadvantages include the placing of limitations on the separation between the emitters and the screen, a reduction in the brightness of the screen, and an increase in the power required to operate the display device.

What is desired is a field emitter based display device in which focusing of the emitted electron beams is performed in a manner which overcomes the disadvantages of currently used methods.

SUMMARY OF THE INVENTION

The present invention is directed to a design for a field emission element, an array of which is incorporated into a flat-panel or other type of display device. The emitter element includes a dopant ferromagnetic material which is added to the material used to form the emitters. The magnetic material is used to produce a permanent magnet in the emitter element which focuses the electrons emitted from the tips of the emitters by means of the magnetic field produced. The magnetic field provides a restoring magnetic force which acts to collimate the diverging electrons back towards a straight line trajectory extending from the emitter tips to the anode electrode, thereby restoring the electrons to motion along a set of closely spaced electric field lines extending between the cathode and anode. This provides a means of controlling the divergence of the electrons and forming them into a tight beam which can be used to produce a high brightness display.

Further objects and advantages of the present invention will become apparent from the following detailed description and accompanying drawings.

DETAILED DESCRIPTION OF THE INVENTION

The present invention of a self-focusing field emission element uses the magnetic field generated by a ferromagnetic material implanted into the emitter to control the divergence of electrons emitted from the emitter tip. The implanted material is used to turn the emitters into a magnetic dipole, having a north magnetic pole at the tip and a south magnetic pole at the base. The magnetic field lines are concentrated at the tip of the emitter. The combination of the magnetic field and the electric field produced between the emitter tip(s) and the anode electrode cause the electrons to move in approximately straight line trajectories to the anode surface. This reduces cross-talk between adjacent pixels, thereby improving the brightness of a display device which incorporates an array of the emitter elements.

Figure 1:
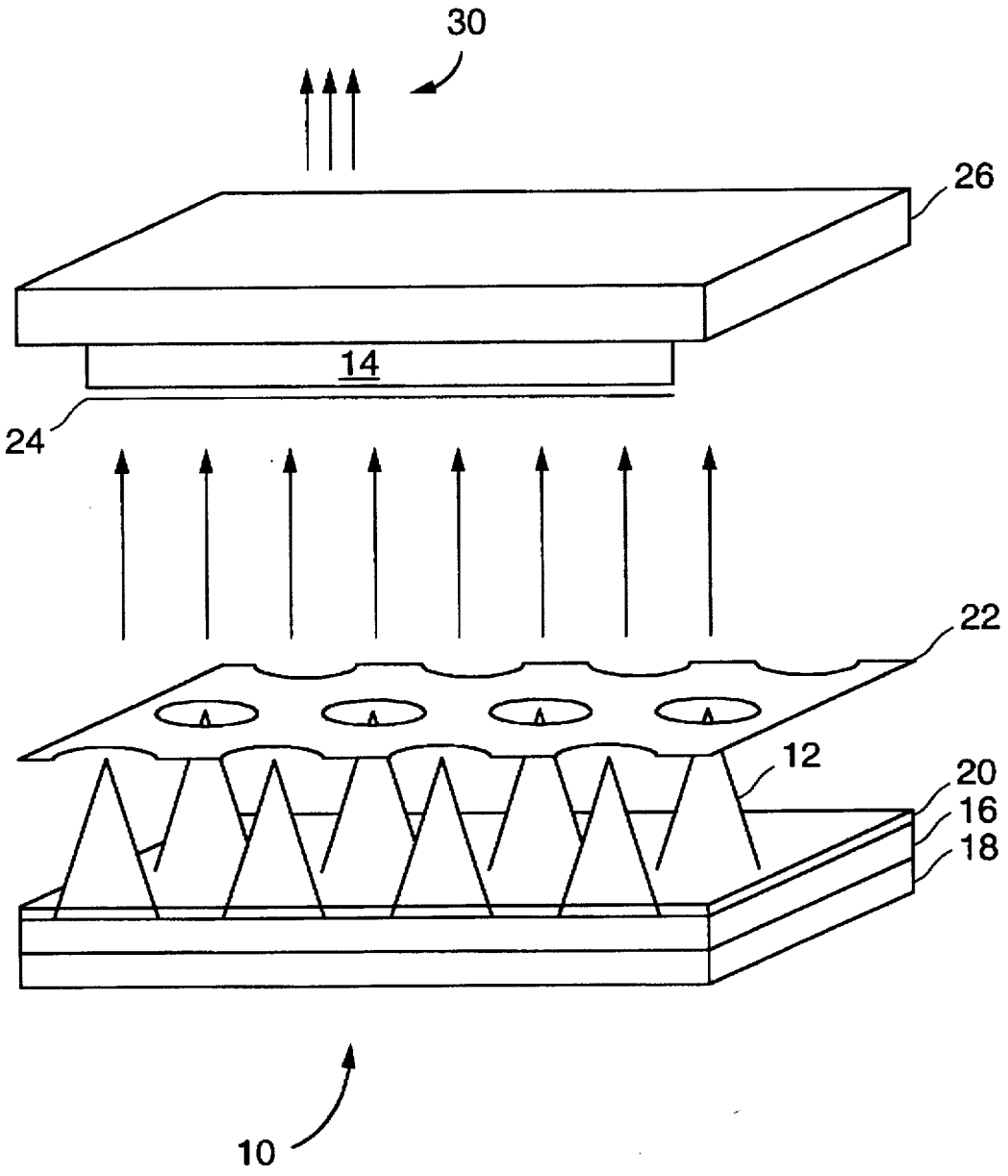
FIGURE 1 (PRIOR ART)
FIG. 1 shows the primary components of a section of a typical field emission display device.
Figure 2:
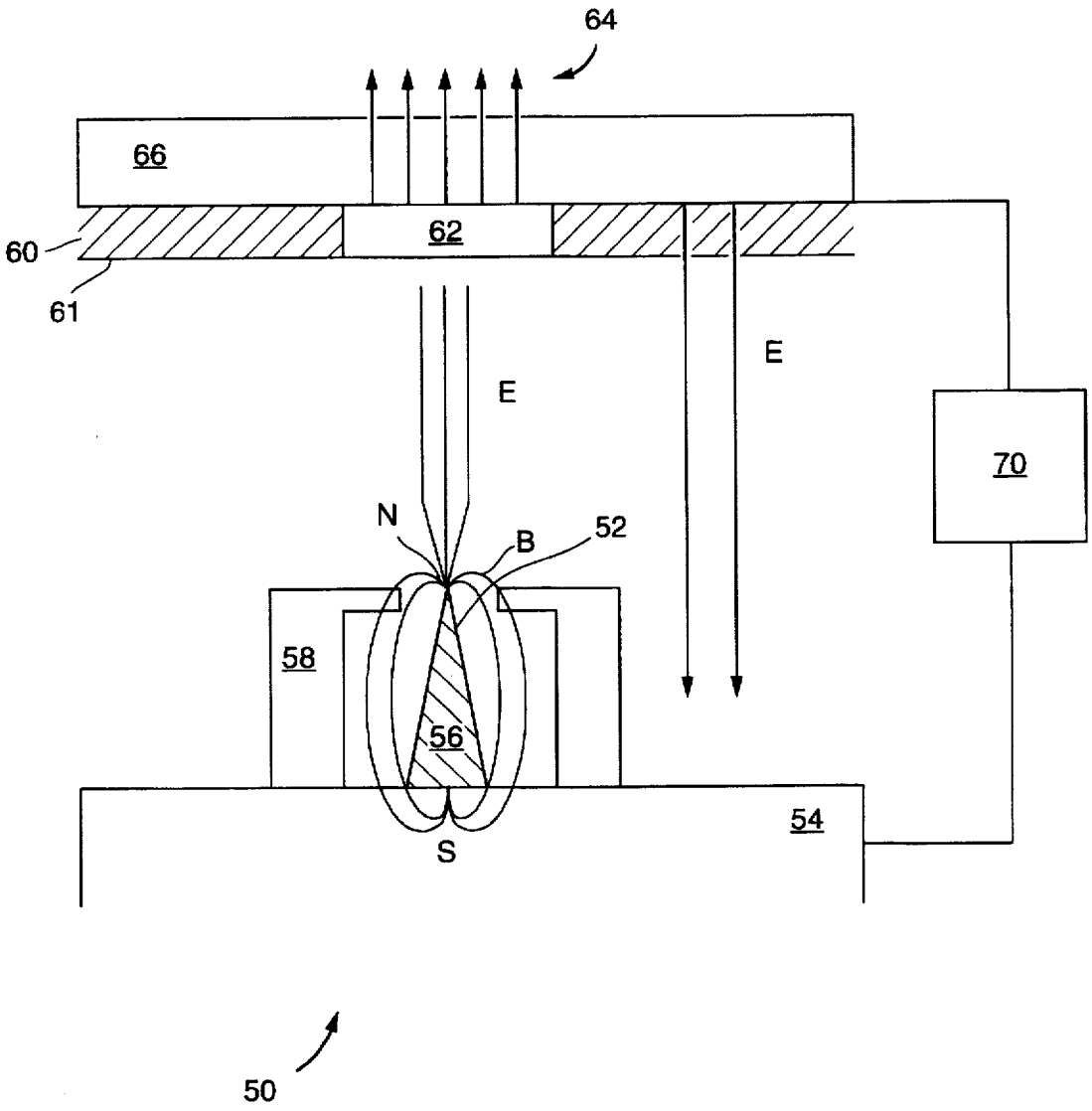
FIG. 2 shows the structure of a single emitter section of a field emission display device which incorporates the magnetically focused field emitter of the present invention.

FIG. 2 shows the structure of a single emitter section of a field emission display device 50 which incorporates the magnetically focused field emitter 52 of the present invention. Field emission display device 50 includes emitter element 52 which typically takes the form of a sharply pointed needle or cone and which is electrically connected to a cathode electrode 54. An array of such emitter elements 52 is used as the electron source for a pixel or sub-pixel of a display. Emitter 52 is fabricated according to one of the methods well known in the art for making an array of field emission elements. A metal evaporation or collimated sputtering fabrication method is well-suited for this purpose. However, in accordance with the present invention, emitter B2 is doped with a ferromagnetic material 56. This doping can be accomplished by an evaporation or sputtering process using dual sources during formation of the emitter tip. The ferromagnetic material is used to create a group of atomic magnetic dipoles within emitter 52. At a suitable point in the fabrication process, a strong electric field is placed across the emitter(s) to align the atomic magnetic dipoles within each emitter. This forms a permanent magnet within each emitter element 52.

The permanent magnet produces a magnetic field B which acts on electrons emitted from the tip of emitter 52, producing a restoring force which causes the electrons' motion to be constrained to an approximately parallel set of electric field lines which extend between the cathode and anode electrodes. This causes the emitted electrons to have less divergence at the anode surface compared to the situation in which no focusing method is used. This focusing method is less expensive and requires a less complex process flow than other focusing methods currently available.

A gate electrode 58 used for controlling the extraction of electrons is formed around emitter tip 52. Gate electrode 52 typically is operated at a voltage of several volts to several hundred volts. Note that the present invention may be utilized in embodiments both with and without a gate electrode. An anode electrode 60 is placed parallel to and spaced apart from cathode electrode 54. When anode electrode 60 and cathode electrode 54 are connected to a source of a potential difference (i.e., a voltage source) 70, an electric field (E) is produced between the electrodes. Source 70 is typically in the range of a several hundred to tens of thousand volts. As shown in the figure (in which the elements' sizes and spacings are exaggerated), in the region near the tip of emitter 52, the electric field lines diverge radially and extend to anode electrode 60. In the region away from the tip of emitter 52, the electric field lines are essentially parallel and connect the cathode to the anode. The electric field exerts a force on the emitted electrons causing them to be accelerated and move toward the anode. Owing both to the shape of the electric field lines and the non-uniformity of the surface of the emitter tip, some of the electrons emitted from the tip will move away from the emitter in a direction away from the normal to the cathode.

A phosphor region 62 is placed on the surface of anode electrode 60, which is typically an aluminum coating used both as the anode and to hold phosphor region 62 in place. Black matrix region 61 fills the space between anode 60 and substrate 66 in the areas not containing phosphor 62. When electrons emitted from the tip of emitter 52 strike phosphor region 62, photons 64 are ejected from the phosphor, producing light which is visible from the back surface of substrate 66 (typically made of glass) which supports the anode electrode.

The force on an electron of charge (q) leaving the tip of an emitter in which is formed a permanent magnetic source is composed of two components:

(1) a force due to the electric field vector (E) produced between the cathode and anode, having a magnitude given by $F_E=qE$ (where $q=-e$, with (e) being the electron charge);

(2) a force due to the magnetic field vector (B) produced by the permanent magnet, having a magnitude given by $F_B=q\ v\ B\ \sin\theta$, where v is the velocity of the electron and $\theta$ is the angle between the magnetic field and velocity vectors.

As is well known, the magnetic field force lines for a permanent magnet form a closed loop, connecting to the magnet at the poles. In the case of the present invention, the magnetic field lines exit the emitter at the tip, which serves as the north pole for the magnet, and re-connect at the base of the tip which forms the south pole. Thus, the region of greatest concentration of the field lines is at the north pole tip and the field lines are approximately parallel to the velocity vector of an emitted electron in this region.

As an electron is emitted from the emitter tip, it is influenced by the electric field between the anode and cathode. This exerts a force on the electron, causing it to be accelerated to the anode electrode, increasing its velocity. If an electron is emitted from the emitter tip in a straight line perpendicular to the cathode surface, then the magnetic field and velocity are parallel, and no magnetic force acts on the electron (i.e., $\sin\theta=0$). The electric field causes the electron to travel to the anode surface in an approximately straight trajectory. It is noted that the electric field strength is approximately zero just outside the emitter tip, since the tip is equipotential with the cathode. Thus, the electric field has very little influence on the electron motion in the region just outside the emitter tip. However, because the magnetic field and electron velocity vectors are essentially parallel, only the electric field has a substantial influence on the electron motion.

When the electron has moved a short distance away from the emitter tip, the magnetic field lines are oriented at an angle to the electron velocity. In this case, the magnetic force on the electron is balanced by the field lines on all sides of the electron trajectory. As a result, the net magnetic force on the electron is approximately zero and the force of the electric field will continue to cause the electron to travel in an approximately straight line trajectory to the anode. Even though the magnetic field and electron velocity are no longer parallel, the magnetic field exerts little influence on the electron motion.

In contrast, if an electron leaves the emitter tip at an angle to a line drawn straight outward from the tip and perpendicular to the anode surface, then a magnetic force due to the permanent magnet contained in the emitter will act to restore the electron to a straight line path. This overcomes the effect of the diverging electric field lines which leave the tip of the emitter, producing a more highly collimated beam.

At and near the emitter tip, the electric field has a value of approximately zero, while the magnetic field value is relatively high. If an electron leaves the tip at an angle, the electric field will have little influence on it, while the magnetic field will exert a greater influence (though one which is limited owing to the small electron velocity) to bring the electron back to a straighter trajectory. Further away from the emitter tip, the magnetic field strength decreases while the electric field increases, thus becoming more of an influence on the electron trajectory.

The total force on an emitted electron is given by:

$$F_T=-e\ (E+v\ B\ \sin\theta).$$

As noted, at a point just outside the emitter tip, the influence of the E field is small, since the potential (V) at the cathode is approximately zero. In addition, the electron velocity is small, so that the magnetic field force, while greater than the electric field force, is also minor, but non-zero. The electric field magnitude can be derived from the gradient of the potential, $$E_z=-\delta V/\delta z$$

where the z direction is defined as the axis extending from the cathode to the anode, with z equalling zero at the cathode. At the cathode electrode, $E_z\approx 0$ since $V\approx 0$. At, and near the emitter tip, the electric field has little influence on the electron, while the magnetic field serves to bring a divergent electron back to the normal. Note that the potential value changes rapidly as the electron moves into the region between the cathode and anode.

Thus, as the electron moves away from the tip of the emitter, it is subjected to forces which act to constrain its motion to travel along a substantially parallel set of field lines, first the magnetic field, then the electric field lines. The result is a highly collimated beam of electrons.

Another source of a force on the electron is due to the potential set up between the gate electrode and the cathode electrode. For a gate electrode potential of $V_g$, the force on an electron is given by $F_g=-e\ V_g$. Since $V_g$ is typically on the order of 20 volts or less, and as in the case of the anode plate voltage, the electric potential at or near the emitter tip due to $V_g$ is essentially zero, $F_g$ is small enough that the electron motion can be controlled by the magnetic field of the emitters in the cases where the electron leaves the emitter tip(s) at an angle to the normal between the cathode and anode.

The magnetically focused field emitter of the present invention can be fabricated by any of the methods currently known in the art. In order to form the emitters in a manner which includes the ferromagnetic material, a collimated sputtering or evaporation method may be used. If an evaporation method is chosen, a two-source evaporator would be desirable. A typical ferromagnetic dopant would be cobalt, with the second evaporator source being molybdenum. In such a case, the emitter material should be approximately 5% cobalt and 95% molybdenum.

The emitters should be uniformly doped with the ferromagnetic material. After application of a strong electric field, this will turn the emitters into permanent magnetic dipoles, having a North magnetic pole at one end (the emitter tips) and a South magnetic pole at the opposite end (the emitter bases). The magnetic field lines will be the closest together at the poles, producing the strongest magnetic field at those locations.

The present invention provides a field emitter suited for use in a flat-panel or other display. The field emitter is fabricated so as to include a ferromagnetic material, thereby producing a magnetically self-focused emitter. The magnetic field resulting from the ferromagnetic material acts to restore electrons to travel along the substantially parallel electric field lines which connect the cathode electrode and anode electrode of the device. This prevents the electrons emitted from the tip of the emitter from diverging significantly as they travel from the cathode region to the anode. The magnetically self-focusing field emitter provides a means for making a high brightness display without the need for a control electrode or the use of high anode switching voltages. This simplifies the design and production of such displays.

The terms and expressions which have been employed herein are used as terms of description and not of limitation, and there is no intention in the use of such terms and expressions of excluding equivalents of the features shown and described, or portions thereof, it being recognized that various modifications are possible within the scope of the invention claimed.

I claim:

1. A flat-panel display device, comprising:

a cathode electrode;

a field emitter arranged on the cathode electrode, the field emitter being formed from a material or materials which includes a ferromagnetic material, the ferromagnetic material forming a permanent magnet which produces a magnetic field in a region external to the field emitter;

a substrate;

an anode electrode disposed on said substrate having a phosphor region thereon spaced apart from the cathode electrode; and a voltage source for producing an electric field in a region between the cathode electrode and the anode electrode.

2. The flat-panel display device of claim 1, further comprising:

a gate electrode placed around the field emitter and between the cathode electrode and anode electrode for extracting electrons from the field emitter.

3. The flat-panel display device of claim 1, wherein the ferromagnetic material is cobalt.

4. The flat-panel display device of claim 1, wherein the ferromagnetic material is evenly distributed within the field emitter.

5. The flat-panel display device of claim 1, wherein the field emitter is in the shape of a cone.

6. A flat-panel display device, comprising:

a cathode electrode;

an array of field emitters arranged on the cathode electrode, wherein each field emitter includes a ferromagnetic material; a substrate;

an anode disposed on said substrate electrode spaced apart from the cathode electrode;

a detector which detects the impact of electrons emitted from the array of field emitters and responds by generating photons of light; and a voltage source for producing an electric field in a region between the cathode electrode and the anode electrode.

7. The flat-panel display device of claim 6, wherein the field emitters in the array of field emitters further comprise:

a gate electrode placed-around the emitter and between the cathode electrode and the anode electrode for extracting electrons from the emitter.

8. The flat-panel display device of claim 6, wherein the ferromagnetic material is cobalt.

9. A method of operating a flat-panel display device, comprising:

forming an array of field emitter elements, wherein the emitter elements include a permanent magnet formed from a ferromagnetic material;

arranging the array of field emitter elements between a cathode electrode and an anode electrode disposed on a substrate, wherein the array of emitter elements is electrically connected to the cathode electrode; and applying a potential between the cathode electrode and the anode electrode having a phosphor region thereon, thereby forming an electric field in a region between the cathode electrode and the anode electrode.

10. The method of claim 9, wherein the field emitter elements are in the shape of a cone.

11. The method of claim 9, wherein the ferromagnetic material is cobalt.

12. The method of claim 9, wherein the ferromagnetic material is evenly distributed within the field emitter elements.

13. The method of claim 9, further comprising the step of:

arranging a gate electrode around each of the field emitter elements and in between the cathode electrode and the anode electrode for extracting electrons from the emitter.

* * * * *

UNITED STATES PATENT AND TRADEMARK OFFICE

CERTIFICATE OF CORRECTION

PATENT NO. : 5,708,327
DATED : January 13, 1998
INVENTOR(S) : JOHN O. O'BOYLE

It is certified that error appears in the above-identified patent and that said Letters Patent is hereby corrected as shown below:

In Col. 8, line 12, after "anode" insert --electrode--.

In Col. 8, line 12, after "substrate" delete "electrode".

In Col. 8, line 22, delete "placed-around" and replace with --placed around--.

Signed and Sealed this

Seventeenth Day of March, 1998

*Attest:*

*Attesting Officer*

BRUCE LEHMAN

*Commissioner of Patents and Trademarks*